US006183575B1

(12) United States Patent
Embelton

(10) Patent No.: US 6,183,575 B1
(45) Date of Patent: Feb. 6, 2001

(54) METHOD AND STRIP FOR SEALING AND FORMATION OF A SEALABLE GROOVE IN A BODY OF SETTABLE MATERIAL

(75) Inventor: George Robert Embelton, Victoria (AU)

(73) Assignee: G. P. Embelton & Co. Pty. Ltd., Victoria (AU)

( * ) Notice: Under 35 U.S.C. 154(b), the term of this patent shall be extended for 0 days.

(21) Appl. No.: 08/776,377

(22) PCT Filed: Jul. 7, 1995

(86) PCT No.: PCT/AU95/00413

§ 371 Date: May 5, 1997

§ 102(e) Date: May 5, 1997

(87) PCT Pub. No.: WO96/04436

PCT Pub. Date: Feb. 15, 1996

(30) Foreign Application Priority Data

Aug. 2, 1994 (AU) ..... PM 7217

(51) Int. Cl.[7] ..... E01C 11/00
(52) U.S. Cl. ..... 156/71; 52/396.04; 404/68
(58) Field of Search ..... 156/71; 264/36.2; 52/396.04; 404/68

(56) References Cited

U.S. PATENT DOCUMENTS 1,701,629 2/1929 Pullar .
4,362,427 * 12/1982 Mass ..... 404/64
4,815,886 * 3/1989 Madsen ..... 404/64
5,168,683 * 12/1992 Sansom ..... 404/68
5,690,447 * 11/1997 Metzger ..... 404/64

FOREIGN PATENT DOCUMENTS

69963/74 12/1975 (AU) .
55056/90 11/1990 (AU) .
661080 6/1938 (DE) .
1684081 8/1990 (DE) .
0469717 2/1992 (EP) .
1198881 12/1959 (FR) .
179785 5/1922 (GB) .
WO8304422 6/1983 (WO) .

* cited by examiner

*Primary Examiner*—Sam Chuan Yao
(74) *Attorney, Agent, or Firm*—Sughrue, Mion, Zinn, Macpeak & Seas, PLLC

(57) ABSTRACT

A method and strip (10) for sealing between opposed surfaces (22, 24), and formation of a sealable groove (20). The method of sealing utilizes a sealing strip which is introduced between the surfaces, and settable material (26) which is provided between the sealing strip and one of the surfaces (22), wherein the sealing strip (10) is provided with an elongate body portion (12) and a lengthwise extending and laterally extending flexible barrier (14), the sealing strip (10) being introduced through an opening defined by the surfaces such that the barrier resiliently engages the surface (22) and, when the strip is in position, provides a barrier between the body portion and the surface.

8 Claims, 10 Drawing Sheets

METHOD AND STRIP FOR SEALING AND FORMATION OF A SEALABLE GROOVE IN A BODY OF SETTABLE MATERIAL

BACKGROUND OF THE INVENTION

This invention relates to method and strip for sealing and formation of a sealable groove in a body of settable material.

In concrete construction work, for example, it is frequently necessary to seal gaps between adjacent surfaces, such as opposed surfaces of a groove. Pre-formed sealing strips may be employed for this purpose. A particularly satisfactory material is expanding cork material such as that sold under the registered trade mark SPANDEX. This material when inserted into a groove will, over time, expand to firmly press against the opposed sides of the groove to provide an effective seal.

While the use of sealing strips as above described is convenient and effective where grooves are of standard configuration, such as having planar opposed parallel surfaces, such that strips of standard complimentary configuration can be readily formed, difficulties may arise where it is desired to seal between opposed surfaces which are not so formed. This may arise, for example where one of two opposed surfaces is irregular. This situation arises particularly where grooves formed in concrete or the like are subjected to erosion such as may occur over a period of service where the concrete work is exposed to the elements, and where it becomes necessary to replace a pre-existing seal. In these cases, where one of the opposed surfaces is linear the sealing strip may be introduced against that surface and any gap as between an opposite irregular surface and the adjacent surface of the sealing strip filled with a fluid settable composition such as cement. In these cases, however, the introduction of the cement filler, which needs to be downwardly compacted, tends to result in the filler passing to the bottom of the groove. It may therefore accumulate at the bottom of the groove and tend to cause the sealing strip to dislodge from the bottom of the groove, or pass the bottom of the sealing strip and be lost if the surfaces to be sealed do not have a base connecting surface. Also, cement filler may bridge the gap which in most instances is formed below the groove by adjacent slabs of concrete between which the groove is formed. This bridging is undesirable because it will then interfere with natural movement of the slaps towards each other, possibly inducing spalling of edges of the slab, directly or indirectly reducing the efficiency of sealing performed by the sealing strip.

SUMMARY OF THE INVENTION

In one aspect, the invention provides a method of sealing between opposed surfaces utilizing a sealing strip which is introduced between the surfaces, and settable material which is provided between the sealing strip and one of the surfaces, wherein the sealing strip is provided with an elongate body portion and a lengthwise extending and laterally extending flexible barrier means, the sealing strip being introduced through an opening defined by the surfaces such that the barrier means resiliently engages said one surface and, when the strip is in position, provides a barrier between the body portion and said one surface.

The settable material is preferably introduced into the groove with the sealing strip but may be introduced after introduction of the sealing strip.

In another aspect, there is provided a sealing strip for use in the abovedescribed method, comprising an elongate body portion and a resiliently flexible barrier means extending lengthwise and laterally of the body portion. Preferably, the barrier means is secured to the body portion adjacent a junction between side and lower end surfaces of the body portion. Preferably, the body portion includes at least one side surface which is non-linear when viewed in cross-section, such as being sinuous or grooved.

The sealing strip may be formed of expandable material such as a composition including expandable cork. Suitable compositions include those containing cork, rubber and a suitable binder. The barrier may be formed of expanded polyethylene or other flexible and/or resilient materials.

In another aspect, the invention provides a method of forming a groove in a body of settable material for introduction of a sealing strip, the groove defining an opening and opposed side surfaces, comprising penetrating the surface of the material, prior to setting, with a forming tool having opposed side portions mounted for movement towards and away from each other, under a condition where the side portions are adjacent each other, to form a depression in the material, moving the side portions away from each other into a spaced condition whereby to sidewardly expand the depression to form the groove, and removing the tool from the groove.

The invention also provides a method of providing a sealing strip in a body of settable material comprising forming a groove by the last described method, and inserting the sealing strip thereinto.

The invention also provides a tool for carrying out the last described method, comprising two elements mounted for movement between a first position, at which first end portions of the elements are adjacent each other to enable the surface of the settable material to be penetrated by movement of the tool into the material with an end portion thereof first, which end portion is defined by the end portions of the two elements, and to a second position at which the elements are moved away from each other for effecting said forming of the groove by sideward displacement of the settable material.

The elements may present substantially parallel outer surfaces when in said second position.

BRIEF DESCRIPTION OF THE DRAWINGS

The invention is further described by way of example only with reference to the accompanying drawings in which.

DETAILED DESCRIPTION OF THE INVENTION

Figure 1:
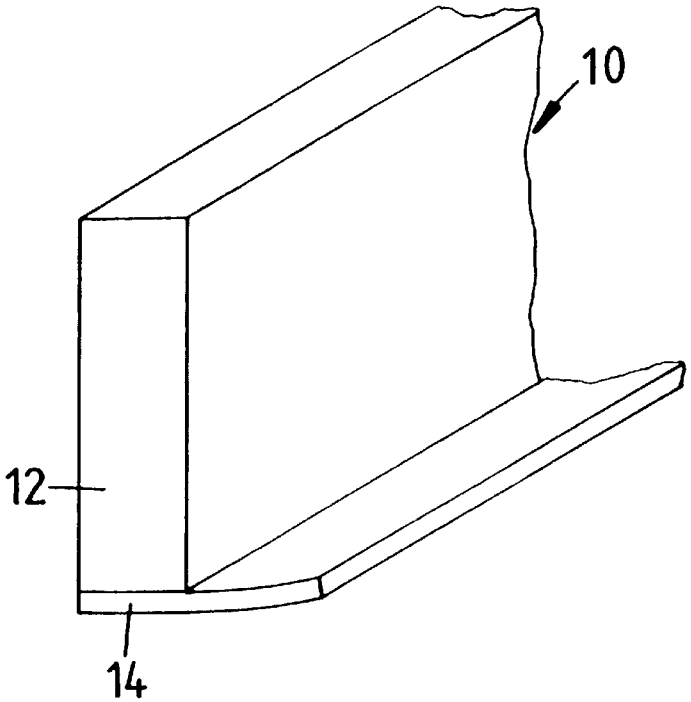
FIG. 1 is a fragmentary perspective view of a sealing strip constructed in accordance with the invention.

FIG. 1 shows a sealing strip 10 formed of an elongate rectangular body portion in the form of strip 12 of self expanding sealing material such as SPANDEX, being a composition formed of cork, rubber and a suitable binder. This material when installed, for example in a groove, will self expand to form a tight seal against adjacent side surfaces of the groove. At the bottom of the strip 12 there is provided a barrier means, in the form of element 14, of expanded polyethylene material, being material which is somewhat flexible and resilient. The element 14 extends lengthwise of the strip and is bonded or otherwise fastened to the under surface of the strip 12 so as to extend sidewardly therefrom.

Figure 2:
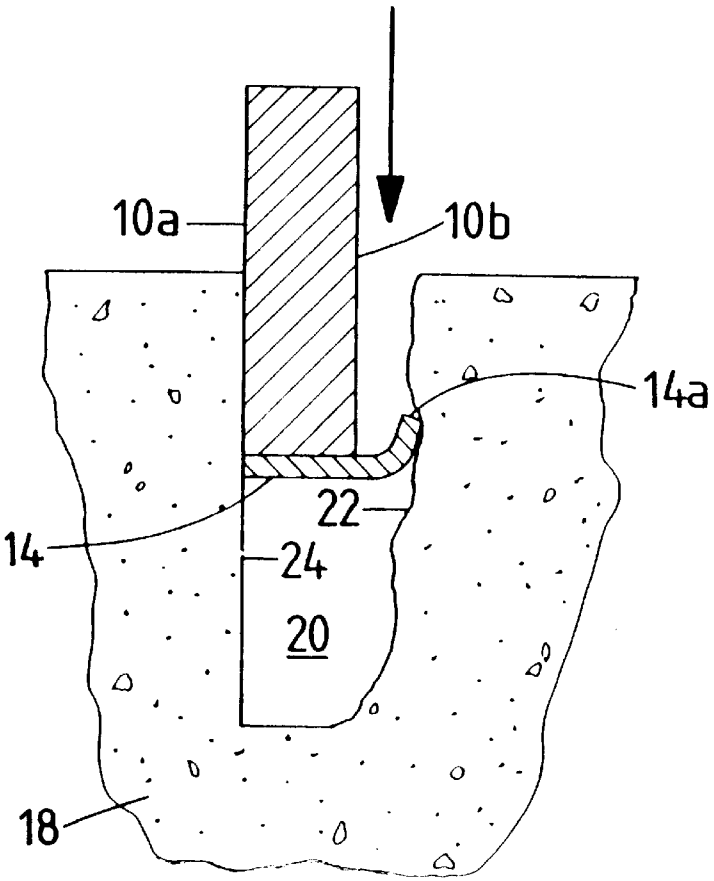
FIGS. 2 to 4 are cross-sectional views showing steps in sealing a groove using the sealing strip of FIG. 1.
Figure 3:
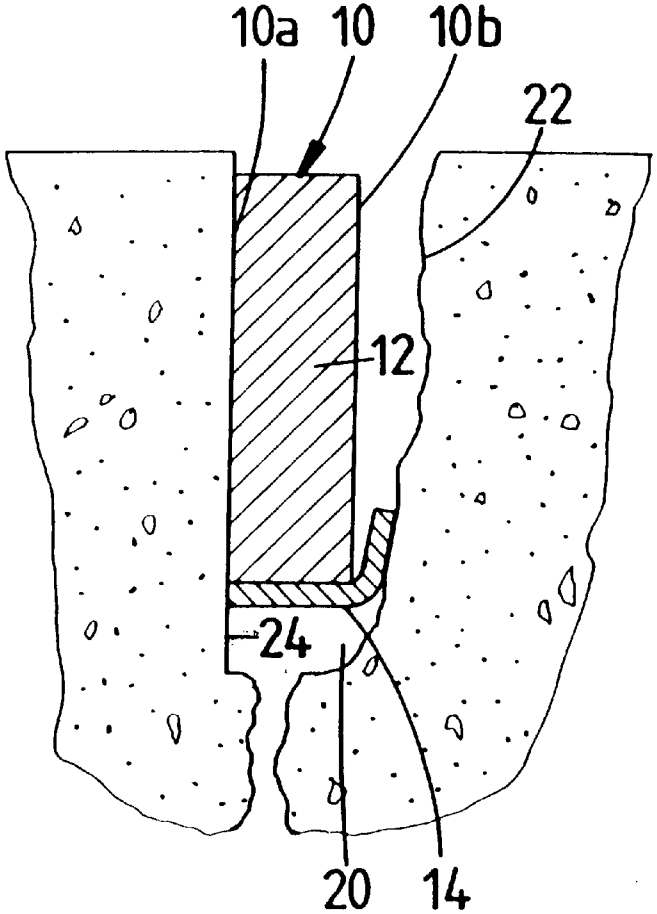

FIG. 2 shows concrete work 18 with a groove 20 formed therein, this having opposed side surfaces 22, 24, of which surface 24 is in this case vertical and linear when viewed in cross-section. The opposite surface 22 is however, of irregular form when viewed in cross-section. In order to provide an effective seal of the groove 20, the strip 10 is introduced into the groove by downward movement, with the element 14 lowermost and with the side face 10*a* of the strip, opposite the side face 10*b* from which element 14 sidewardly extends, adjacent surface 24. Thus, the element 14 extends sidewardly from the strip 10 towards surface 22. As the strip 10 is directed downwardly, toward the bottom of the groove 20, the outer free edge 14*a* of the element 14 engages the surface 22 and is upwardly deflected and partially compressed as shown in FIG. 3.

Figure 4:
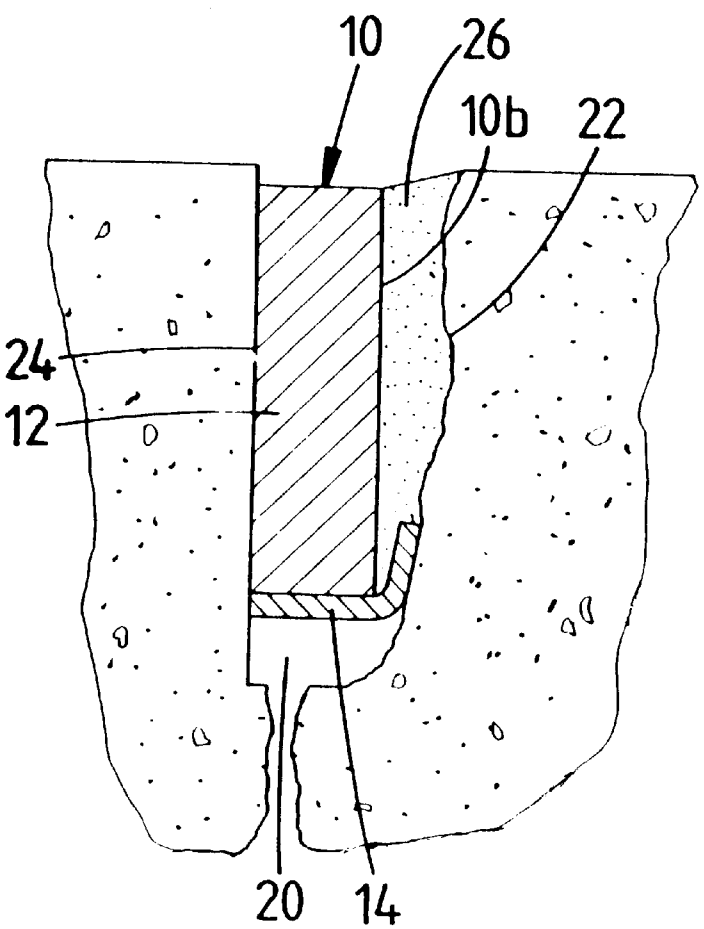

As shown in FIG. 4, a suitable settable material 26 is then introduced into the space between the side face 10*b* of strip 10, and the surface 22 of the groove. This material may comprise, for example an acrylate cement such as one formed from hydraulic cement mixed with an acrylic emulsion. This material may be pressed downwardly into the space between face 10*b* and surface 22 to fill entirely the space down to the location of the element 14, which prevents further downward passage of the material. Thus, the element 14 provides an effective barrier to passage of the material 26 below the sealing strip 10, and thus acts to prevent undesired penetration of material 26 to this location, which would have the undesirable effects above described.

By making element 14 resilient, it will resiliently bias the strip 10 away from surface 22, against surface 24, to facilitate easy entry of the settable material into the space between the sealing strip and the surface 22.

Figure 5:
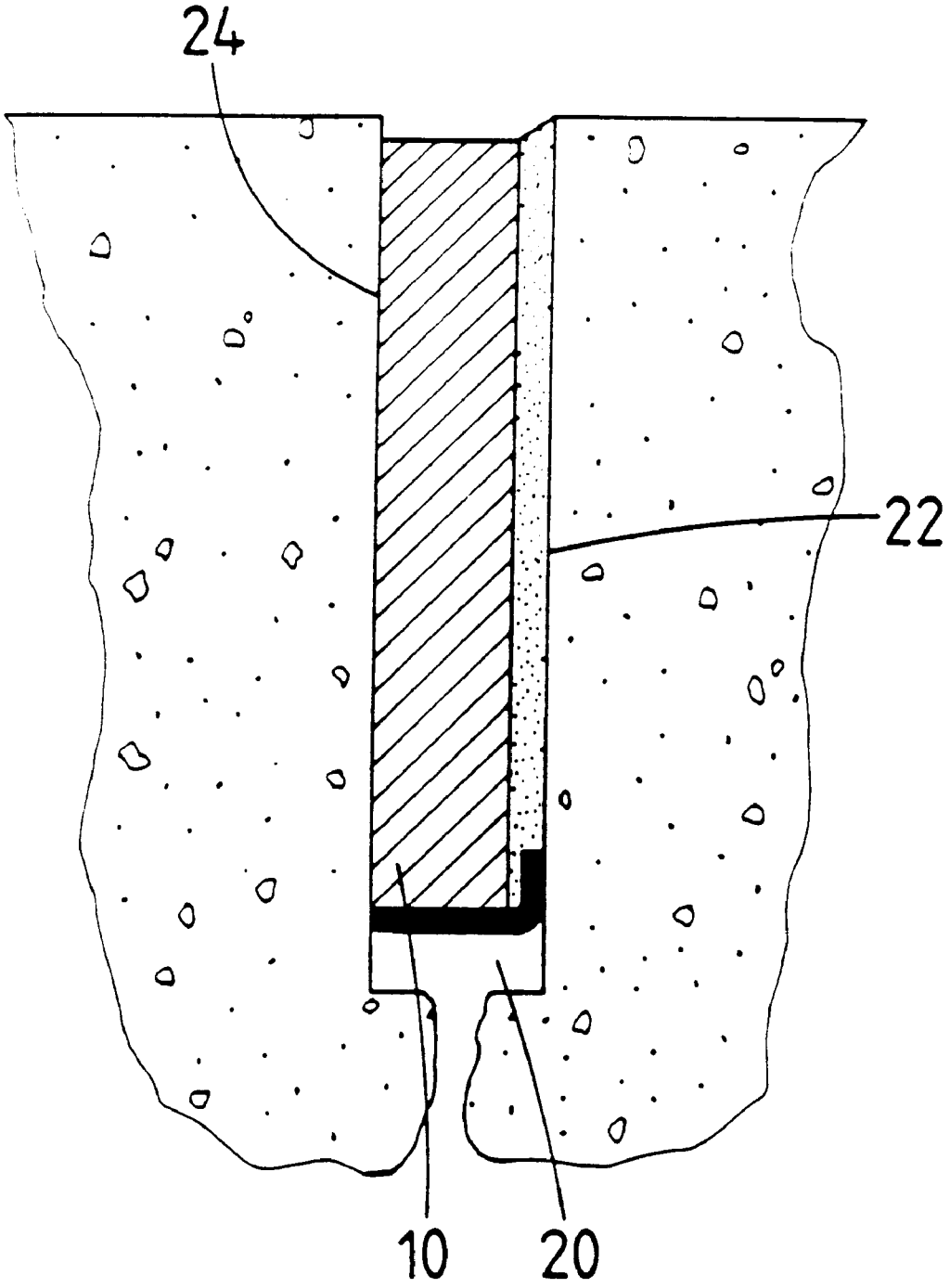
FIG. 5 is a cross-sectional view of a further groove sealed in accordance with the method of this invention.

It is possible to adapt the method above described for use in other situations. For example, FIG. 5 shows sealing strip 10 applied in the groove 20 where both opposed side surfaces 22, 24 are generally parallel and planar.

Figure 6:
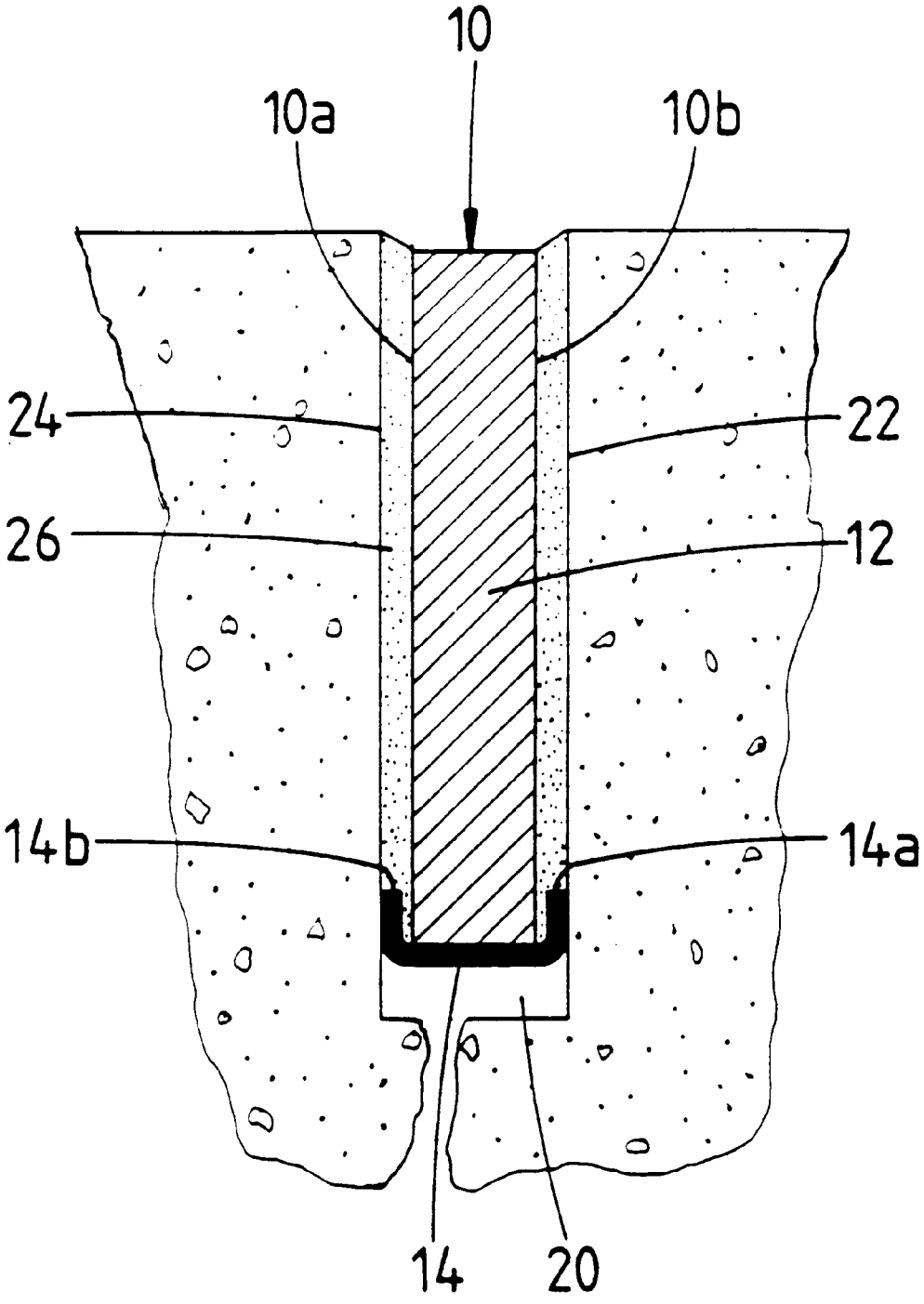
FIG. 6 is a view like FIG. 5 but showing a modified form of sealing strip constructed in accordance with the invention.

FIG. 6 shows a modified form of the strip 10 where the rectangular strip 12 of self expanding sealing material is of similar form to that described previously, but where the element 14 is secured to the lower surface of the strip 12 so as to project to either side of the strip rather than simply to one side as shown. In this case, the action of inserting the strip 10 will tend to centre the strip 12 as the opposed side edges 14*a*, 14*b* engage the side surfaces 22, 24 of the groove 20. In this case, then, there will be gaps between the side surfaces 10*a*, 10*b* and the respective opposed surfaces 24, 22 of the groove. In this case, then, these two gaps are each sealed by introduction of settable material 26.

Figure 18:
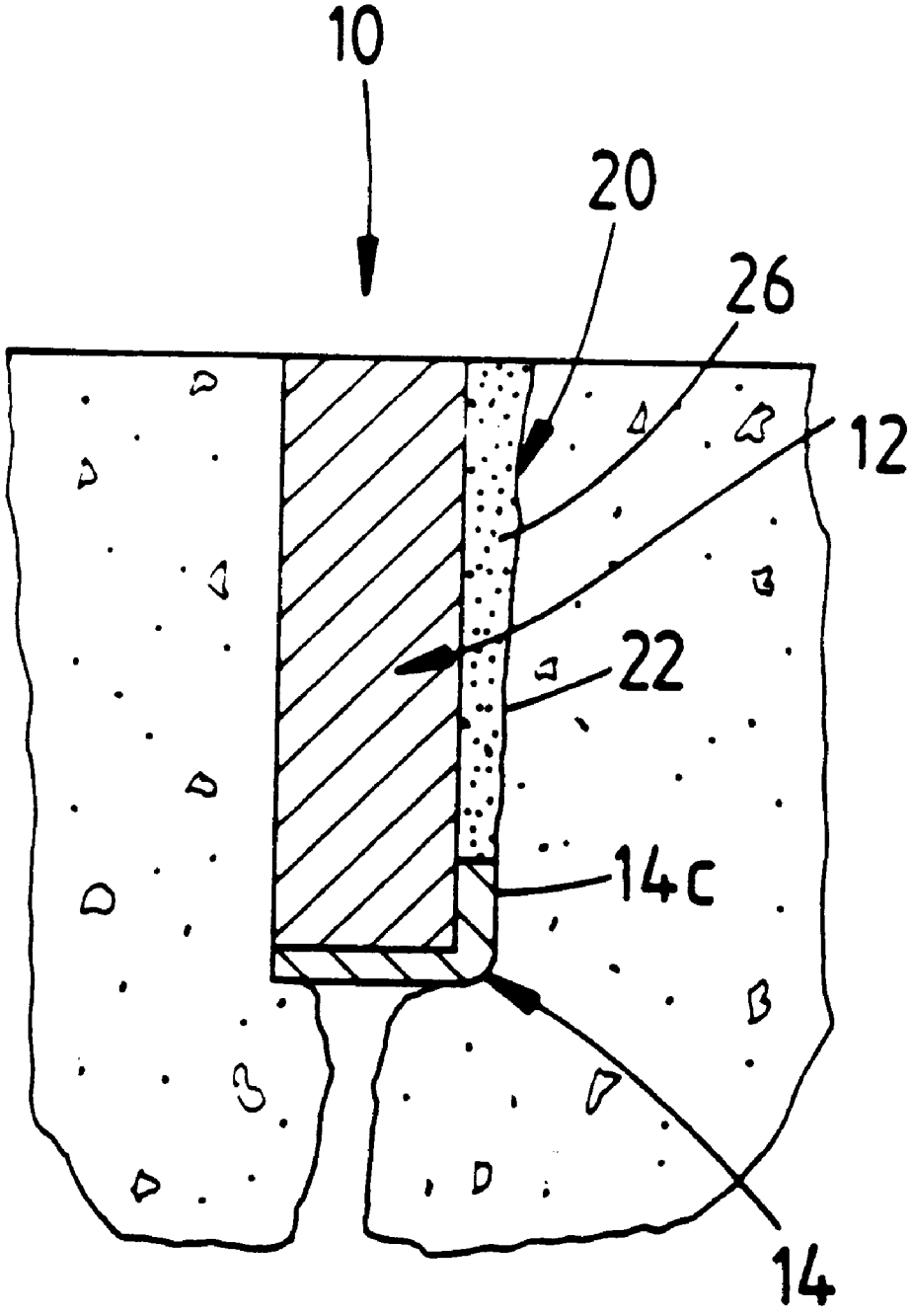
FIG. 18 is a view like FIG. 5 but showing a sealing strip having a modified seal element.

FIG. 18 shows a further modification where the rectangular strip 10 and element 14 are of somewhat similar form and material to that above described. In this case, however, the element 14 is considerably thicker, so that when the strip 10 is inserted into the groove the sidewardly projecting portion 14*c* of the strip is compressed between the side of the strip 12 and the side surface of groove 20, to improve the sealing action.

Figure 14:
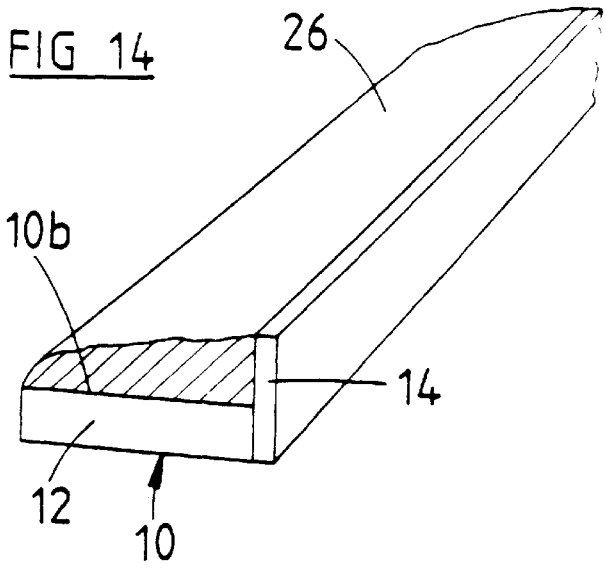
FIG. 14 is a perspective view of a sealing strip in accordance with the invention, showing an alternative method of use thereof.

While, in the described arrangement, the settable material 26 is applied into the space formed between the sealing strip 10 and a side surface of the groove, it is possible to introduce the settable material with the sealing strip. Thus, FIG. 14 shows the sealing strip 10 with the rectangular strip 12 of self-expanding sealing material, and the element 14 laid on its side with element 14 extending in upright fashion from the strip 12. Then, the settable material 26 is introduced onto the upper surface 10*b* of strip 12 and trowelled over this and against the sealing strip 14. Then, the strip 10 is introduced into the groove 20 in the same way as previously described the excess material 26 rising above the groove and being towelled off as required. Also, if the material 26 is sufficiently thixotropic, it may be applied to the strip 12 when the strip is in the vertical condition, rather than being on its side as described.

Figure 15:
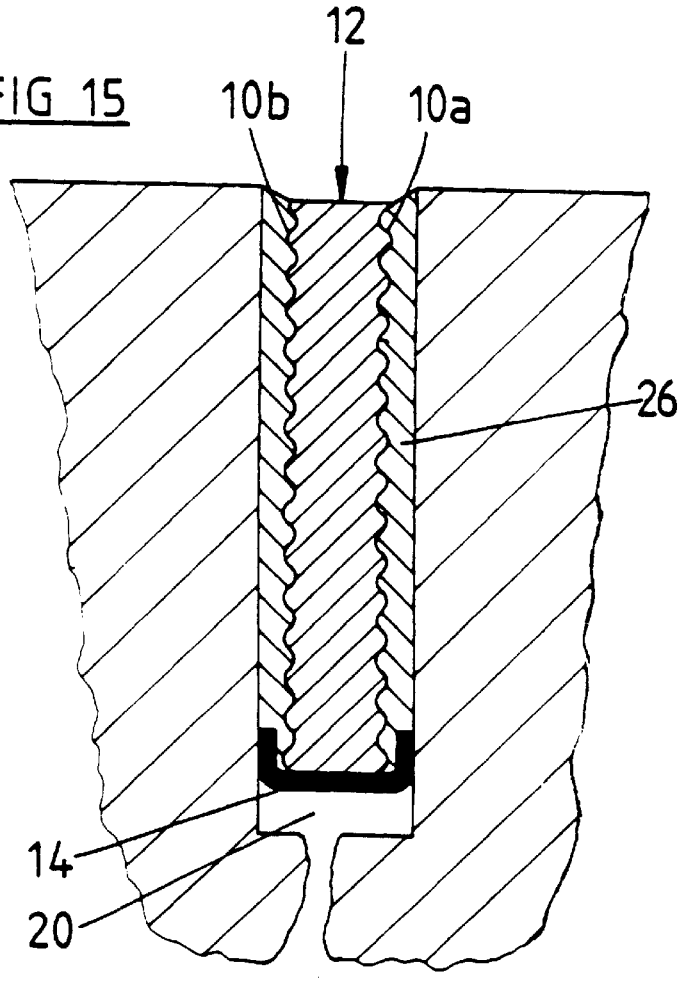
FIG. 15 is a view like FIG. 5, but showing a modified form of sealing strip.

The sealing strip 12 may be of different form to that described. In particular the strip 12 may be configured with a sinuous side surface 10*a* or 10*b* or with both side surfaces being so configured, as shown in FIG. 15. This facilitates the keying action as between the material 26 and the strip 12. This sinuous configuration may be applied even in the case where strip 10 does not include the element 14.

EXAMPLE

Installation of SPANDEX*

In order to effect repair and seal the joint between two concrete slabs, a selfexpanding sealer strip of SPANDEX* material with dimensions of approximately 12 mm thickness and 50 mm depth was installed using a settable adhesive cement applied to one face prior to installation.

Adhered to the bottom edge of the spandex strip and protruding approximately 8 mm, was a semi rigid polyethylene foam element of approximately 6 mm thickness, designed to contain the adhesive cement during insertion of the Spandex into the joint groove. To the top edge was bonded a plastic tape to be removed after insertion of the SPANDEX* into the joint, designed to leave a clean upper surface.

Trowelled directly on to the side surface of the SPANDEX* strip, the adhesive cement was of a consistency similar to Plaster of Paris and sufficiently thixotropic to avoid slump and hold to the vertical face of the SPANDEX* material as it was being inserted into the joint opening.

One side of the joint opening had been cleaned and was substantially normal to the pavement surface. The other joint face was less regular such that the width of the joint gap varied from approximately 14 mm to 18 or even 20 mm in some places.

The SPANDEX* material was grooved on one side, being the side to which the adhesive was applied and was inserted into the joint opening with its flat side toward the clean, vertical face of the joint.

Some force was required to insert the strip into the joint, with the foam retaining element along the bottom edge and the flat face of the SPANDEX* material hard against the clean face of the joint, because the foam was thicker than the gap between the Spandex and the opposite face of the joint and this resulted in the foam being compressed. Compression of the foam in this way prevented any ingress of the adhesive into the joint below the Spandex. It also forced the adhesive to flow against the face of the joint and firmly held the opposite side of the Spandex strip against the clean face during the insertion process.

Some surplus adhesive was forced from the top of the groove, indicating the gap between the SPANDEX* material sealing strip and the rougher joint face had been filled with the settable material. Such surplus was easily cleared away before the plastic tape bonded to the top edge of the SPANDEX* material was removed to leave a clean, sealed joint repair, flush with the pavement surface.

*SPANDEX is a Registered Trade Mark.

Referring now to FIGS. 7 to 13, there is depicted therein a method of forming a groove 20 in a body of settable material 18. In this method, the groove is formed after the material 18 has been poured to form an upper surface 18*a* (FIG. 7) but before the material has set.

Figure 7:
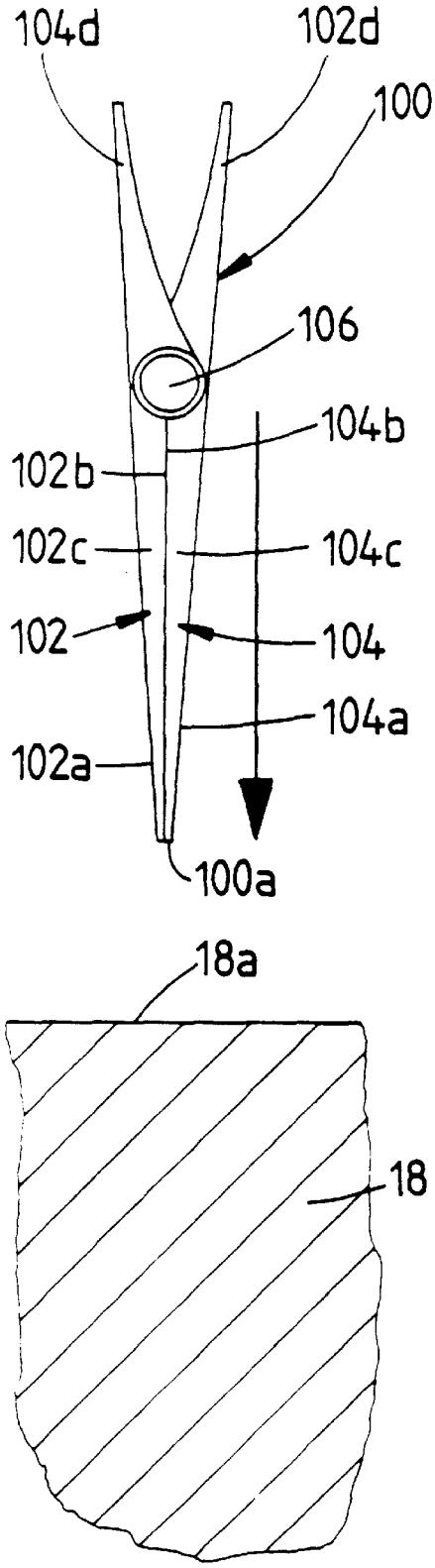
FIGS. 7 to 13 illustrate a method of forming a groove, in accordance with the invention.
Figure 10:
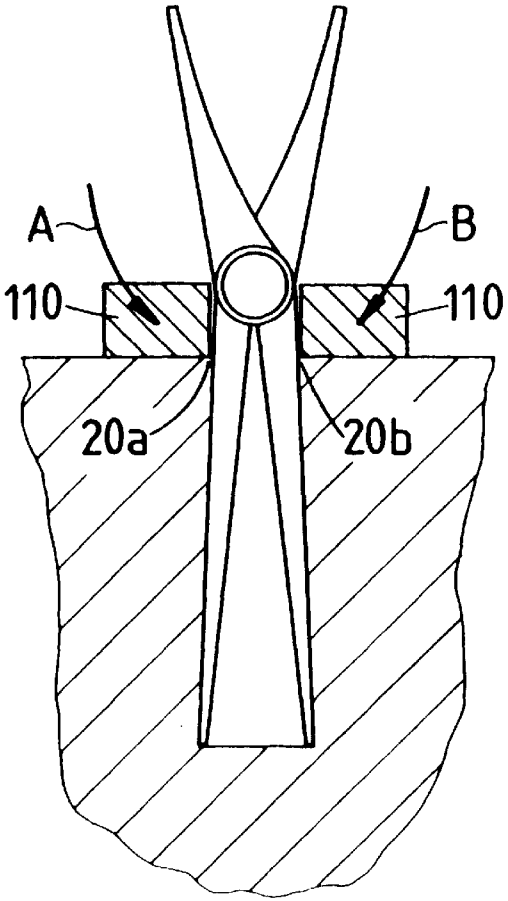
Figure 9:
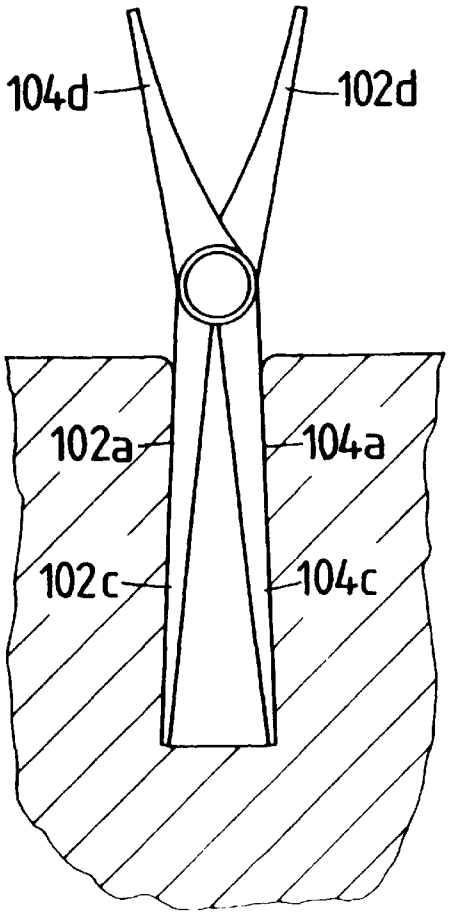

The method employs a tool 100 comprising two elongate side elements 102, 104 which have planar outer faces 102*a*, 104*a*. The two elements 102, 104 are hinged together in any suitable fashion so as to be swingable about a pivot axis 106 to and between a first position such as shown in FIG. 7, at which portions 102*c*, 104*c* on which the faces 102*a*, 104*a* are formed, extend away from the pivot axis 106 in closely adjacent relationship with inner surfaces 102*b*, 104*b* thereof adjacent, and a second position such as shown in FIGS. 9 and 10 where the portions 102*c*, 104*c* are separated. This movement is effected by manipulating portions 102*d*, 104*d* of the elements 102, 104, these being in the form of handle-like structures extending away from axis 106 in the opposite direction to portions 102*c*, 104*c*.

The portions 102*c*, 104*c* are somewhat wedge-shaped when the tool is viewed from the end as shown in FIG. 7 and, when in the position shown in FIG. 7, the tool presents a somewhat wedge-shaped configuration with a somewhat pointed end 100*a* at the extremities of portions 102*c*, 104*c*. On the other hand, when portions 102*d*, 104*d* are moved away from each other, the configuration shown in FIGS. 9 and 10 is adopted at which the extremities of the portions 102*c*, 104*c* are also moved away from each other and the surfaces 102*a*, 104*a* are somewhat parallel to each other.

Figure 8:
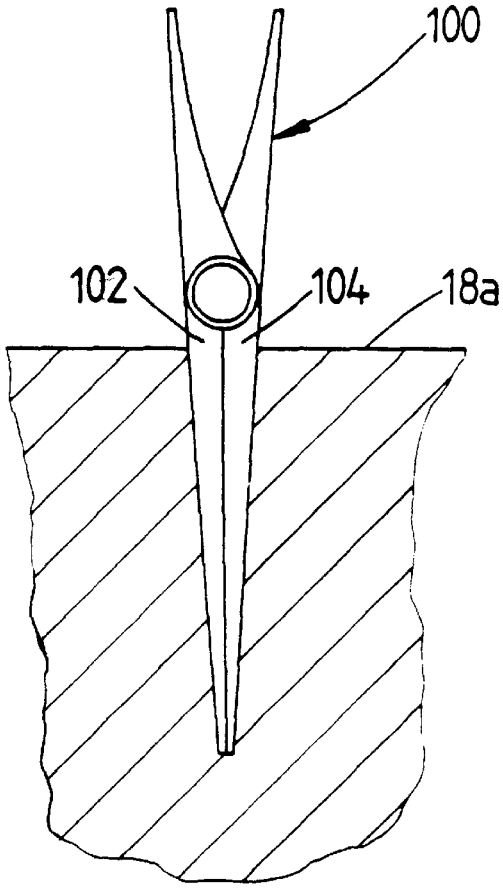

The first step in forming the groove 20 is illustrated in FIGS. 7 and 8 where the tool 100 is advanced to penetrate the surface 18*a* of the body of the material 18. This is done with the pointed end 100*a* of the tool being lowermost so that this end of the tool penetrates the body of material first. Penetration is carried out to a depth equal to the desired depth of the groove to be formed.

The depression formed by so pressing the tool 100 into the material 18 is, as shown in FIG. 9, subsequently widened by moving the portions 102*d*, 104*d* of the tool away from each other to correspondingly move the now lowermost ends of the tool likewise away from each other as shown in FIG. 9. As mentioned, in this case, the outer surfaces 102*a*, 104*a* may assume somewhat parallel disposition, although this is not essential. It may, for example, be desired to form a groove which has downwardly divergent sides or, even for that matter, upwardly divergent sides. In these cases, the extent of opening of the tool is selected as desired.

Following widening of the groove as shown, the groove work is substantially completed by moving block elements 110 to compress the material 18 at the surface 18*a* to form neat corners 20*a*, 20*b* of the groove 20. This may be effected by forcing the elements 110 against the surface and towards the opposed sides of the tool, such as by movement in the direction of the arrows A and B in FIG. 10.

Figure 11:
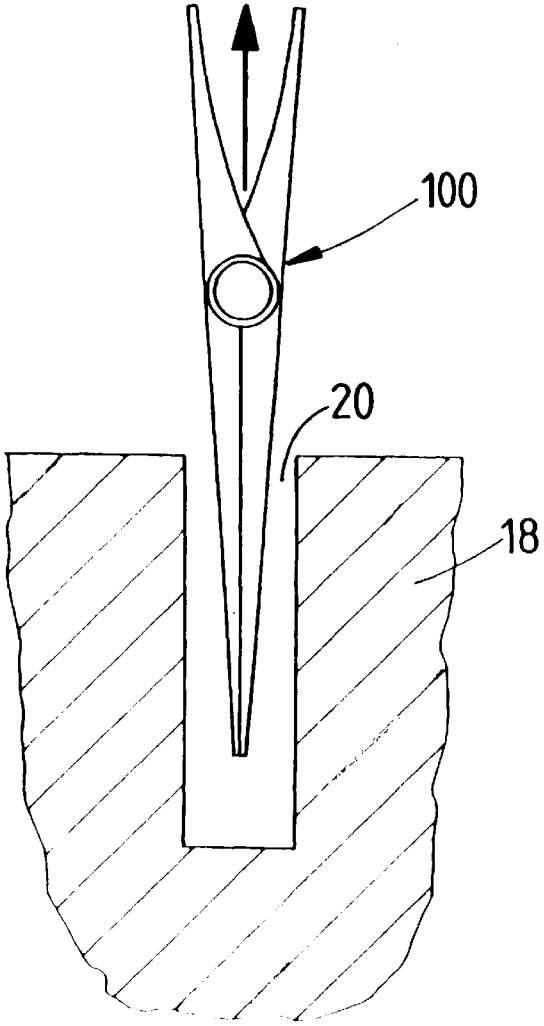

Subsequently the block elements 110 are removed, the tool reverted to its closed condition and withdrawn from the groove 20 as shown in FIG. 11.

Figure 13:
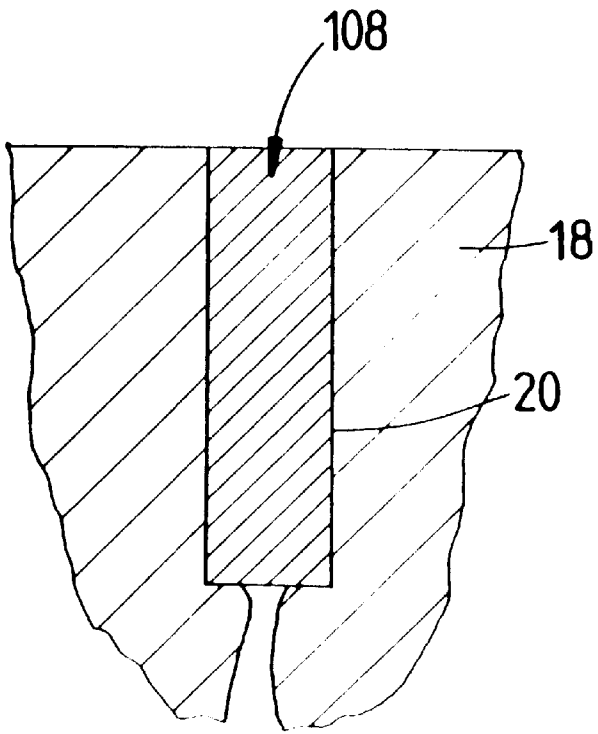
Figure 12:
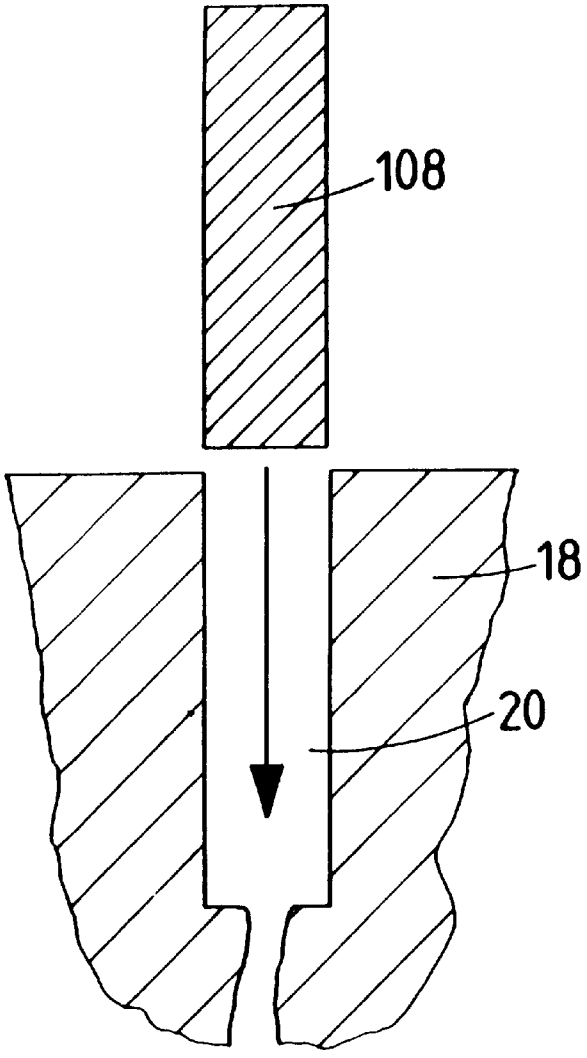

Then, the strip 108 of sealing material is entered into the groove 20 to complete the sealing of the groove, as shown in FIGS. 12 and 13. This step may be effected either before setting of the material 18 or afterwards.

Figure 17:
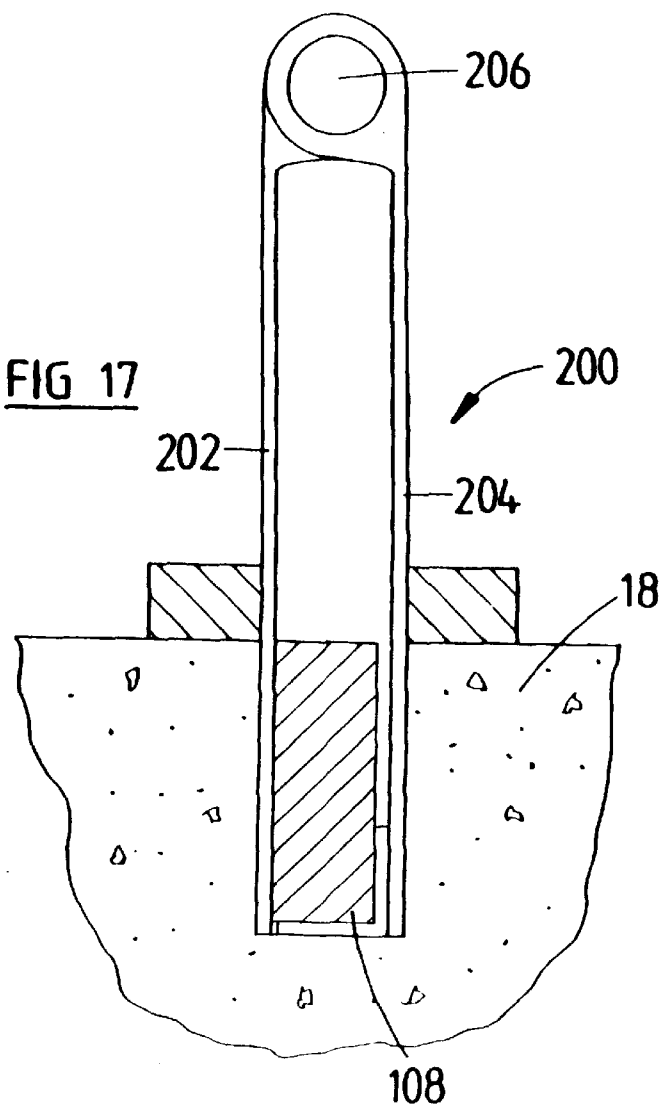
FIGS. 16 to 17 are views similar to FIG. 10 but showing steps in use of a modified tool to form a groove.
Figure 16:
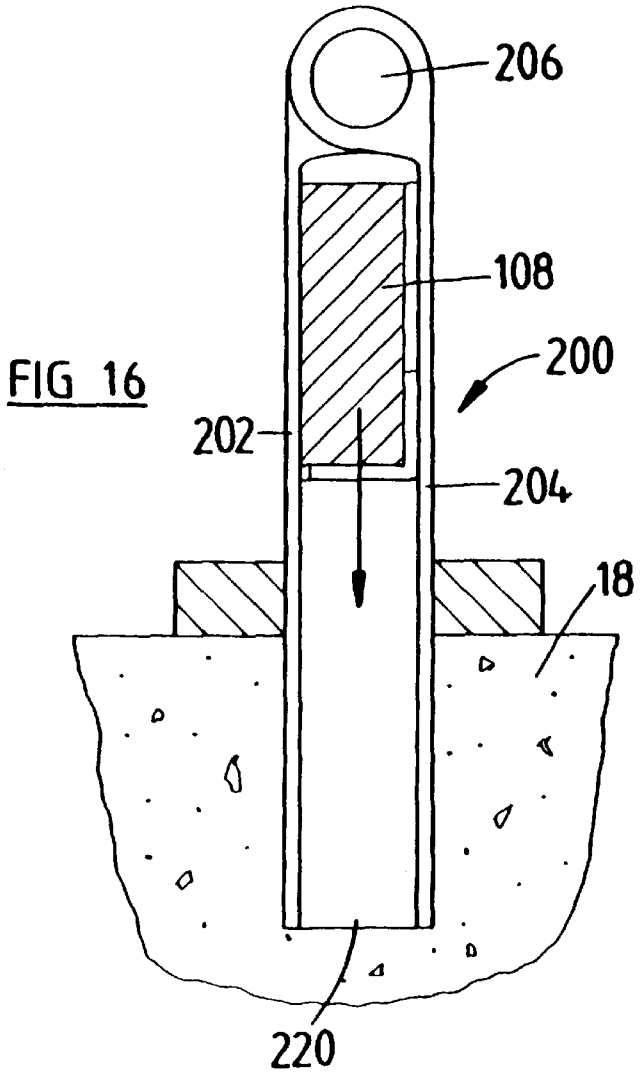

In FIGS. 16 and 17, a tool 200 somewhat similar to tool 100 is used in a similar fashion to the manner described with reference to FIGS. 7 to 11, to form a groove 220. The tool has side elements 202, 204 somewhat similar to side elements 102, 104 of tool 100 and can be pivoted about a pivot 206 to a position (not shown) at which the free ends come together, to facilitate penetration of the body of material 18, and then pivotally separated to form the groove 220. In this case, the scaling strip 108 is introduced into the groove 220 before the tool 200 is withdrawn. The sealing strip may be accommodated within the tool 200 before the tool is advanced into the material 18, or it may be introduced after the side elements of the tool are opened to form the groove.

In the methods described with reference to FIGS. 7 to 17, the block elements 110 may be left in place as the tool 100 or 200 is withdrawn.

The described construction has been advanced merely by way of explanation, and many modifications and variations may be made thereto without departing from the spirit and scope of the invention which includes every novel feature and combination of features herein disclosed.

What is claimed is:

1. A method of sealing between opposed surfaces utilizing a sealing strip which is introduced between the surfaces, and settable material which is provided between the sealing strip and one of the surfaces, wherein the sealing strip is provided with an elongate body portion and a flexible barrier means secured thereto which extends lengthwise of the body portion and extends laterally outwardly from the body portion, the sealing strip being introduced through an opening defined by the surfaces such that the barrier means resiliently engages said one surface and, when the strip is in position, provides a barrier between the body portion and said one surface, wherein the settable material is provided on the strip and supported by the barrier means prior to introduction of the strip between the surfaces.

2. A method as claimed in claim 1, wherein the strip is introduced between the surfaces such that the barrier means is positioned remotely from the opening.

3. A method as claimed in claim 2, wherein the resilient engagement of the barrier means against said one surface serving to bias the body portion against the opposite surface.

4. A method of sealing between opposed surfaces utilizing a sealing strip which is introduced between the surfaces, and settable material which is provided between the sealing strip and one of the surfaces, wherein the sealing strip is provided with an elongate body portion and a flexible barrier means secured thereto which extends lengthwise of the body portion and extends laterally outwardly from the body portion, the sealing strip being introduced through an opening defined by the surfaces such that the barrier means resiliently engages said one surface and, when the strip is in position, provides a barrier between the body portion and said one surface, wherein the strip is introduced between the surfaces using a tool used to form the opening and opposed surfaces, the tool subsequently being removed through the opening.

5. A method as claimed in claim 4, wherein the strip is introduced between the surfaces such that the barrier means is positioned remotely from the opening.

6. A method as claimed in claim 4, wherein the resilient engagement of the barrier means against said one surface biases the body portion against the opposite surface.

7. A method of sealing an upwardly open gap between two spaced surfaces comprising:

a) providing a sealing strip comprising an elongate body formed of self-expandable material and having first and second opposed side surfaces, said body having barrier means secured to and extending lengthwise of the body and extending outwardly from the body with respect to said first side surface, adjacent to a corner of the cross-section of the body formed by said first side surface and a further surface of the body extending between said side surfaces, said barrier means being formed of resilient material;

b) introducing said sealing strip into said gap by passing it downwardly thereinto, such that the further surface is lowermost and the side surfaces are generally parallel to the spaced surfaces, and such that the barrier means at a lengthwise extending free edge portion thereof engages one of said spaced surfaces such as to cause the barrier means to resiliently and sealingly press thereagainst, and to position said second side surface of the body against the other said spaced surface and to maintain the first side surface of the body spaced from the other said spaced surface;

c) introducing settable material into the gap so as to substantially fill the space between the first side surface of the body and said other said spaced surface, leakage of the settable material downwardly past the barrier means being substantially precluded by the sealing engagement of said free edge portion of the barrier means with said other spaced surface;

d) allowing said settable material to set;

e) allowing said body to self expand so as to provide an effective seal between the first side surface thereof and a then formed adjacent surface of the set settable material and between the second side surface and the other said spaced surface, wherein the settable material is placed on the sealing strip before the sealing strip is introduced into the gap.

8. A method of sealing an upwardly open gap between two spaced surfaces comprising:

a) providing a sealing strip comprising an elongate body formed of self-expandable material and having first and second opposite side surfaces, said body having barrier means secured to and extending lengthwise of the body and extending outwardly from the body with respect to each said side surface, adjacent to respective corners of the cross-section of the body formed by said side surfaces and a further surface of the body extending between said side surfaces, said barrier means being formed of resilient material;

b) introducing said sealing strip into said gap by passing it downwardly thereinto, such that the further surface is lowermost and the side surfaces are generally parallel to the spaced surfaces, and such that the barrier means at lengthwise extending free edge portions at opposite sides of the body engage respective ones of said spaced surfaces such as to cause the barrier means to resiliently and sealingly press thereagainst, and to position the side surfaces of the body spaced from respective opposed ones of said spaced surfaces,;

c) introducing settable material into the gap so as to substantially fill the spaces between the side surfaces of the body and the respective opposed said spaced surfaces, leakage of the settable material downwardly past the barrier means being substantially precluded by the sealing engagement of said free edge portions of the barrier means with said spaced surfaces;

d) allowing said settable material to set;

e) allowing said body to self expand so as to provide an effective seal between the side surfaces thereof and then formed adjacent surfaces of the set settable material, wherein the settable material is placed on the sealing strip before the sealing strip is introduced into the gap.

* * * * *